United States Patent [19]

Martin

[11] 4,223,809

[45] Sep. 23, 1980

[54] DISPENSING DEVICE

[76] Inventor: Ronald D. Martin, 9804 Hearthside Cir., Shreveport, La. 71118

[21] Appl. No.: 949,667

[22] Filed: Oct. 10, 1978

[51] Int. Cl.[2] ..... B65D 35/54

[52] U.S. Cl. ..... 222/96; 222/101; 222/105; 74/128; 74/141

[58] Field of Search ..... 74/128, 141; 401/152, 401/155, 158, 163–168; 222/93, 95–105

[56] References Cited

U.S. PATENT DOCUMENTS

| | | | |
|---|---|---|---|
| 921,969 | 5/1909 | Flynn | 74/141 |
| 1,841,275 | 1/1932 | Baptiste | 222/102 |
| 1,989,713 | 2/1935 | Smith et al. | 222/96 |
| 2,812,880 | 11/1957 | Altman | 222/101 |
| 3,204,823 | 9/1965 | Watson | 222/105 |
| 3,252,624 | 5/1966 | Watson | 222/96 |
| 4,019,655 | 4/1977 | Moeller | 222/101 |

*Primary Examiner*—H. Grant Skaggs

[57] ABSTRACT

A wall or table-mounted cream or paste dispensing device which includes a mounting base and a cooperating brush holder and cover and further characterized by a travelling carriage which is fitted with a roller to effect collapse of a toothpaste or other cream-containing tube, which roller is constrained to move downwardly against the tube in discrete increments by activation of a lever and pull chain combination. The carriage travels on the chain responsive to manipulation of the lever, and paste or cream is dispensed in controlled quantities from a nozzle communicating with the compressed tube.

11 Claims, 9 Drawing Figures

DISPENSING DEVICE

BACKGROUND OF THE INVENTION

1. Field of the Invention

This invention relates to dispensing apparatus and more particularly, to a toothpaste or cream dispensing apparatus which may be designed for wall mounting or for positioning on a counter top or lavatory for dispensing of the desired toothpaste or cream. The dispensing device of this invention is characterized by a base member, a brush holder, and a removable cover, whch in combination carry a movable carriage and roller and a chain and cooperating lever for effecting controlled travel of the carriage and roller with respect to the base and cover to facilitate the emission of a controlled quantity of toothpaste or cream from a supply tube placed inside the cover and in cooperation with the travelling carriage and roller system. The dispensing device is characterized by high efficiency in that a controlled quantity of toothpaste or other cream, such as hand lotion, can be dispensed with each manipulation of the lever, and leakage of paste or cream from the tube between dispensing operations is kept to a minimum. The dispensing device can be easily fitted to an interior wall at a convenient location, and in another embodiment may be placed on a counter top for portable access. The dispensing mechanism is simple yet efficient, and can be manipulated by persons of all ages.

2. Description of the Prior Art

Dispensing apparatus for toothpaste and other viscous materials such as hand cream and the like have long been known in the prior art. For example, U.S. Pat. No. 1,156,106 to R. S. Smart discloses a toothpaste dispensing device which includes a tubular container carrying a tube of toothpaste and a ratchet mechanism for effecting forced collapse of the tube to cause emission of toothpaste at the bottom of the device responsive to manipulation of a spring-loaded lever mechanism. A later device is disclosed in U.S. Pat. No. 1,930,821 to P. A. Newcomer, et al, in his Tube Cream Dispenser, which also includes a generally cylindrically shaped body with a threaded post in the center and a carriage and roller combination travelling on the threaded post to effect forced collapse of the tube and ejection of a controlled quantity of toothpaste responsive to manipulation of a lever located at the top of the apparatus. Another similar dispenser is disclosed in U.S. Pat. No. 3,257,037 to C. B. Watson, Jr. The Collapsible Tube Squeezer illustrated in that patent includes yet another cylindrically shaped device capable of housing a collapsible tube of toothpaste or other cream, and is fitted with a pair of rollers at the base, which rollers are positioned in cooperation with a pair of flat metal members traversing the length of the tube and caused to approach each other to squeeze the tube upon manipulation of a lever located at the top of the device to eject a controlled quantity of paste or cream from the tube.

Some of the primary problems realized in prior art cream or toothpaste dispensing apparatus is the lack of positive sealing to prevent leakage and hardening of the material dispensed, and lack of mechanical simplicity of such devices, and the general lack of asthetic appeal regarding design and ease of operation. Cost of manufacture is another problem inherent in many of these devices, and this factor becomes more important as the dispenser design becomes more complex.

Accordingly, it is an object of this invention to provide a new dispensing device which is characterized by positive sealing to prevent leakage of the dispensed material, and aesthetic appeal both as to design and ease of operation, as well as functional utility in providing a support for toothbrushes and a glass or cup, which device may be wall mounted, or in another embodiment, placed on a counter top, lavatory or sink area.

Yet another object of the invention is to provide a new and improved toothpaste dispensing device which is lever-operated and which can be quickly and easily utilized to dispense a controlled quantity of toothpaste on a toothbrush in a single manipulation of the lever.

Another object of this invention is to provide a toothpaste or other cream dispensing device which is characterized by a travelling carriage and roller combination in cooperation with a lever-manipulated chain, which lever effects a controlled movement of the carriage and roller against an internally positioned collapsible tube to dispense a selected quantity of toothpaste from the device during each manipulation of the lever.

A still further object of the invention is to provide a new and improved toothpaste dispensing device, the cover of which can be quickly and easily removed from the base member and brush holder to remove a depleted tube and insert a fresh tube by anyone of sufficient age to need the use of a toothbrush.

A still further object of the invention is to provide a new and improved paste or cream dispensing device for ejecting a controlled quantity of toothpaste or cream by manipulation of a lever, which further includes a mounting base sufficiently large to carry several toothbrushes and a glass or cup mounted in cooperation with the dispensing mechanism for improved efficiency and utility of the dispensing device.

SUMMARY OF THE INVENTION

These and other objects of the invention are provided in a dispensing device which includes a base member, a brush holder in cooperation with the base member and interiorly provided with a paste cavity and a lever slidably positioned beneath the paste cavity and attached to one end of a length of pull chain. The opposite end of the pull chain is attached to the base member by means of a spring, and a carriage and roller combination travels on the chain in cooperation with the base member. The device further includes a removable cover for securing a collapsible paste or cream supply tube adjacent the roller and carriage means to facilitate controlled collapse of the tube by successive downward movement of the carriage and roller on the chain responsive to manipulation of the lever to dispense a controlled quantity of toothpaste or cream from the paste cavity.

BRIEF DESCRIPTION OF THE DRAWNGS

The invention will be better understood by reference to the accompanying drawing, wherein.

Figures 1, 2, 3, 4, 5, 6, 7, 8, 9:
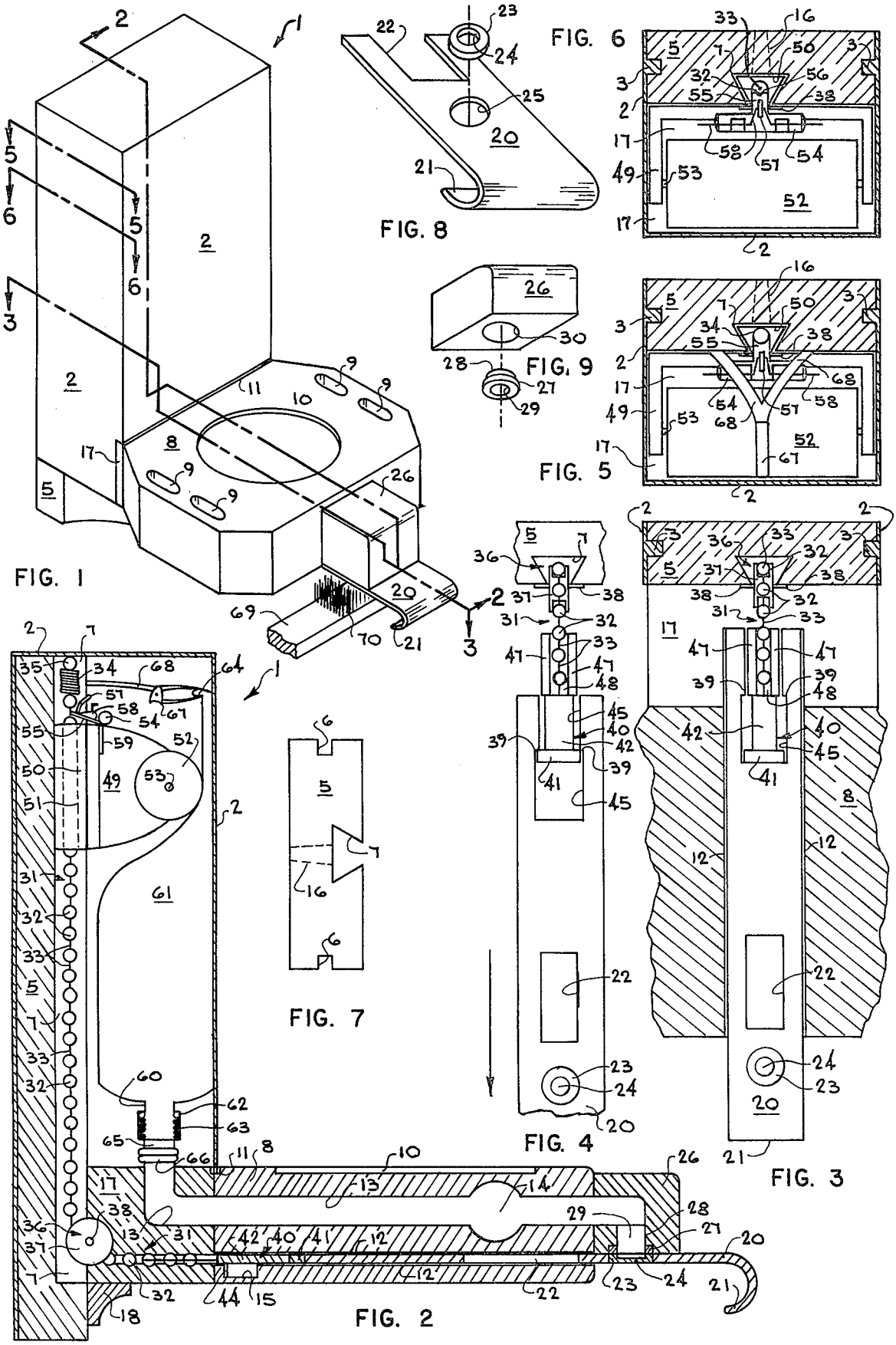
FIG. 1 is a perspective view of a preferred embodiment of the dispensing device of this invention adapted for wall mounting.
FIG. 2 is a sectional view of the dispensing device illustrated in FIG. 1 and taken along lines 2—2 in FIG. 1, more particularly showing a preferred interior mechanism of the device.
FIG. 3 is another sectional view of the dispensing device illustrated in FIG. 1 and taken along lines 3—3 in FIG. 1, more particularly illustrating the lever and pull chain combination.
FIG. 4 is another sectional view of the dispensing device illustrated in FIG. 1 also taken along lines 3—3 of FIG. 1, with the lever moved forward of its position shown in FIG. 3.
FIG. 5 is a sectional view of the dispensing device illustrated in FIG. 1 and taken along lines 5—5 in FIG. 1, and further illustrating the carriage and roller combination of the dispensing mechanism.
FIG. 6 is another sectional view of the dispensing device illustrated in FIG. 1 and taken along lines 6—6 in FIG. 1, more particularly showing the carriage and roller mechanism.

FIG. 7 of the invention is a top view of the base member of the dispensing device illustrated in FIG. 1;

FIG. 8 is a perspective view, partially in section, of a frontal segment of the dispensing lever of this invention; and FIG. 9 is a perspective view of a preferred nozzle of the dispensing device of this invention.

DESCRIPTION OF THE PREFERRED EMBODIMENTS

Referring now to FIGS. 1, 2, 6 and 7 of the drawing, the dispensing device of this invention is generally illustrated by reference numeral 1, and includes a cover 2, which removably slides over a mounting base 5 and cover base 17 to mate with cover slot 11, as illustrated in FIG. 1. A brace 18 is fitted between mounting base 5 and brush holder 8 as illustrated in FIG. 2. Cover 2 is fitted with projecting cover guides 3 which register with cover guide slots 6 in mounting base 5, as illustrated in FIGS. 6 and 7 of the drawing. In the case of models designed to rest on a sink, lavatory or counter top, the bottom surface of mounting base 5, illustrated in FIG. 1, would be generally coextensive with the bottom surfaces of cover base 17 and brush holder 8, and the dispensing device 1 is further mounted on a base (not illustrated) to permit placing toothbrushes in brush apertures 9 provided in brush holder 8. Accordingly, as further illustrated in FIG. 1, in a preferred embodiment of the invention the brush holder 8 further includes brush apertures 9 for receiving toothbrushes, and also features a glass or cup seat 10 to facilitate resting of a glass or cup securely but removably on brush holder 8. Furthermore, a nozzle 26 is mounted on the front end of brush holder 8, and a lever 20, fitted with a lever handle 21, is positioned immediately beneath nozzle 26 and is slidably disposed inside lever aperture 12 of brush holder 8 and in cover base 17, as is more particularly shown in FIG. 2. Brush holder 8 further includes a paste cavity 13 which is disposed in generally parallel relationship to lever aperture 12, and extends through the interior of cover base 17 with one end opening upwardly to receive a connecting tube 65. The opposite end of paste cavity 13 terminates in the interior of nozzle 26, with nozzle insert aperture 29 of nozzle insert 27 coextensive with the base of paste cavity 13, as illustrated. In a preferred embodiment of the invention, paste cavity 13 is also fitted with a surge chamber 14, which serves to reduce the paste or cream pressure in paste cavity 13 after the dispensing of a quantity of paste or cream, and helps reduce the leakage of paste or cream from nozzle 26 between manipulations of lever 20.

Referring now to FIGS. 2–4 of the drawing, as heretofore described, lever 20 is slidably positioned in lever aperture 12 provided in brush holder 8 and cover base 17. As illustrated in FIGS. 3 and 4, lever 20 is also provided with a paste access aperture 22 near the forward end, and an engaging plate slot 45, which narrows near the rear end thereof to form lever shoulders 39. An engaging plate 40 is fitted inside engaging plate slot 45 when lever 20 is in normally retracted position as illustrated in FIG. 3 of the drawing. Engaging plate 40 includes an engaging plate leg 42, which carries an engaging plate head 41 at the forward end thereof. Engaging plate leg 42 rests against a base rest 47 which is fitted with a base rest channel 48 to accommodate pull chain 31, one end of which is attached to engaging plate leg 42. Base rest 47 is mounted in cover base 17 in fixed relationship. Base pin 44 extends downwardly from a point of attachment to engaging plate leg 42 into a lever stop slot 15 provided in brush holder 8, which limits the travel of lever 20, as illustrated in FIG. 2. Lever 20 also carries a lever insert 23, fitted with a lever insert aperture 24, with lever insert 23 positioned in lever insert seat 25, as further illustrated in FIG. 8 of the drawing. The lever insert aperture 24 is designed to mate with nozzle insert aperture 29 of nozzle insert 27, with nozzle insert 27 fitted in nozzle insert seat 30, of nozzle 26, as illustrated in FIGS. 2 and 9. As further illustrated in FIGS. 3 and 4 of the drawing, in a preferred embodiment of the drawing pull chain 31 is characterized by a plurality of balls 32 connected by a plurality of links 33, with one end of the chain attached to engaging plate leg 42 of lever slide 40, and the opposite end attached to a spring 34, as illustrated in FIG. 2. Spring 34 is in turn suspended in the upper segment of a generally "dove tail" shaped carriage slot 7, provided in mounting base 5, by means of a spring pin 35, and pull chain 31 extends through carriage guide aperture 51 of carriage 49 downwardly through carriage slot 7 to spring roller 36, where it rides on roller drum 37 of spring roller 36 in a 90 degree turn to the point of attachment to engaging plate leg 42 of engaging plate 40. Spring roller 36 rotates on roller pin 38 responsive to the manipulation of lever 20 and the travel of pull chain 31 as hereinafter described.

Referring now to FIGS. 2, 5 and 6 of the drawing, carriage 49 is fitted with a carriage guide 50, which, in a preferred embodiment, is generally "dovetail" in shape in order to mate and register with carriage slot 7 in mounting base 5. Carriage 49 is slidably positioned inside cover 2 and carries a carriage roller 52, rotatable on a carriage roller pin 53, as illustrated. Carriage travel hinge 54 is attached to carriage 49 by means of a hinge mount 59 and hinge mount screws (not illustrated), with a retaining arm 55 extending toward pull chain 31, and a retaining arm slot 56, provided in retaining arm 55, pressed against one of the links 33 which is appropriate to the position of carriage 49 inside housing 2, as illustrated in FIG. 6. Arm release 57, which is provided on retaining arm 55, serves to pivot retaining arm 55 upward in carriage travel hinge 54 to release it from engagement with a selected one of balls 32 and links 33 in order to facilitate movement of carriage 49 upwardly on pull chain 31 with respect to housing 2 and mounting base 5 when it is desired to load a new collapsible tube 61 inside dispensing device 1. When retaining arm 55 is in functional position with retaining arm slot 56 adjacent a specified one of links 33 and retaining arm 55 is positioned beneath one of balls 32, arm bias 58, which is attached to carriage 49, serves to bias retaining arm 55 downwardly and against the top of carriage guide 50 and the respective one of balls 32 and links 33 in question. This mechanical arrangement permits a graduated downward movement of carriage 49 and carriage roller 52 with downward displacement of pull chain 31, as hereinafter described. As further illustrated in FIG. 2 of the drawing, a paste or cream-containing collapsible tube 61 is positioned inside cover 2 by inverting the tube, removing the cap, engaging the tube neck 60 with connecting tube 65 as hereinafter described, and attaching the tube base 64 to a tube clip 67, mounted by means of tube clip arms 68 to the top of mounting base 5.

In operation, referring again to the drawing, the dispensing device 1 of this invention is mounted, loaded and operated as follows. Cover 2 of dispensing device 1 is initially grasped and moved upwardly with cover guides 3 disengaging cover guide slots 6 to remove cover 2 from mounting base 5. A set of screws (not illustrated) are placed in registration with screw mount apertures 16 provided in mounting base 5, and mounting base 5 is tightened against a selected wall area by driving the screws into the wall. Arm release 57 is then manipulated to release the pressure of arm bias 58 from retaining arm 55 and remove retaining arm 55 and retaining arm slot 56 from engagement with the specific one of balls 32 and links 33 of pull chain 31 with which the arm and slot were engaged, to permit carriage 49 to slide freely upward on pull chain 31. The tube base 64 of a spent collapsible tube 61 is then removed from engagement with tube clip 67, and the connecting tube cap 62, flanged onto connecting tube 65 and fitted with interior connecting tube threads 63 is turned in the clockwise direction to disengage connecting tube threads 63 from the threads on tube neck 60 of collapsible tube 61, as illustrated in FIG. 2. The empty collapsible tube 61 is then discarded, and a fresh tube is secured to connecting tube 65 by counterclockwise rotation of connecting tube cap 62 to loosely secure connecting tube 65 to collapsible tube 61. The new collapsible tube 61 is then oriented with respect to tube clip 67 such that tube base 64 can be attached to tube clip 67 as illustrated in FIG. 2, and connecting tube cap 62 is tightened on tube neck 60. Expansion collar 66 is provided in connecting tube 65 to more easily align connecting tube cap 62 on the threaded tube neck 60 of collapsible tube 61 while inserting a new collapsible tube 61 in dispensing device 1. Cover 2 is then repositioned on mounting base 5 by engaging cover guides 3 with cover guide slots 6 and mating the bottom of cover 2 with cover slot 11, as illustrated in FIG. 1.

When, for example, the material in collapsible tube 61 is toothpaste and it is desired to dispense the toothpaste from the collapsible tube 61 and dispensing device 1, a toothbrush 69, having bristles 70, is removed from the appropriate brush aperture 9 of brush holder 8 and is positioned beneath nozzle 26 and lever 20, as illustrated in FIG. 1. Lever 20 is then pulled forward as indicated in FIG. 4 of the drawing to the point where lever shoulders 39, which narrow engaging plate slot 45, engage engaging plate head 41 of engaging plate 40. At this point, paste access aperture 22 in lever 20 is displaced in lever aperture 12 to a point beneath nozzle insert aperture 29, which provides an opening in lever 20 to permit paste located in paste cavity 13 to flow through paste cavity 13, surge chamber 14, and nozzle insert aperture 29 onto the toothbrush. Additional displacement of lever 20 in the direction of the arrow shown in FIG. 4 causes engaging plate 40 to move forward and displace pull chain 31 against the bias of spring 34 in carriage slot 7. Since retaining arm 55 and retaining arm slot 56 are secured beneath a selected one of balls 32 and links 33 of pull chain 31, carriage 49 and carriage roller 52 are displaced downwardly with pull chain 31 a selected distance to effect a partial collapse of collapsible tube 61 and force toothpaste from collapsible tube 61 through connecting tube 65 and into paste cavity 13 and surge chamber 14. It has surprisingly been found that the presence of an enlarged area or surge chamber 14 in paste cavity 13 reduces the post lever manipulation pressure at nozzle insert aperture 29 to prevent undesirable leakage. Return of lever 20 to its original position as illustrated in FIGS. 2 and 3 of the drawings releases tension on pull chain 31 and permits pull chain 31 to move upwardly in carriage slot 7 and through carriage guide aperture 51 in carriage 49 responsive to the pull of spring 34. Each successive one of balls 32 and links 33 which are in the vicinity of retaining arm 55 move upwardly past retaining arm 55 and retaining arm slot 56 until spring 34 returns to its original configuration, and a different and lower one of balls 32 and links 33 is positioned adjacent retaining arm 55 and retaining arm slot 56. Continued manipulation of lever 20 in the manner described above results in a controlled quantity of toothpaste dispensed from nozzle insert aperture 29 of nozzle 26 with the mating of lever insert 23 and nozzle insert 27 effecting a seal of nozzle insert aperture 29 to prevent undesirable leakage of the toothpaste or cream from, or hardening in, nozzle insert aperture 29, between each manipulation.

It will be appreciated by those skilled in the art that when the initial collapsible tube 61 is placed in dispensing device 1 as above described, several manipulations of lever 20 will be necessary in order to fill paste cavity 13 and surge chamber 14 prior to the dispensing of paste or cream from nozzle insert aperture 29. However, after paste cavity 13 is full, a single manipulation of lever 20 in the manner described above will effect ejection of a controlled quantity of paste or cream from nozzle insert aperture 29 each time lever 20 is pulled outwardly.

Referring now to FIGS. 8 and 9 of the drawing, in a preferred embodiment of the invention, and as heretofore described, lever 20 is fitted with a lever insert seat 25 provided in the surface of lever 20, and a lever insert 23 having a lever insert aperture 24, the top surface of which is substantially flush with lever 20. Furthermore, nozzle 26 is additionally provided with a similar nozzle insert 27, the nozzle insert mouth 28 of which is designed to mate with the bore of paste cavity 13 which is situated in essentially horizontal configuration inside nozzle 26. Nozzle insert 27 is also fitted with a nozzle insert aperture 29 and is designed to fit inside a nozzle insert seat 30 provided in nozzle 26 such that the bottom surface of nozzle insert 27 is essentially coextensive with the bottom surface of nozzle 26. Accordingly, referring again to FIG. 2 of the drawing, it will be appreciated that when lever 20 is in the normally closed position the exposed surfaces of lever insert 23 and nozzle insert 27 are in mating cooperation, and no toothpaste or cream is permitted to drip from paste cavity 13. Displacement of lever 20 in the direction indicated by the arrow in FIG. 4 of the drawing causes paste access aperture 22 to register with nozzle insert aperture 29 to permit paste or cream to flow from nozzle insert aperture 29 as heretofore described.

Referring again to FIGS. 2 and 5 of the drawing, it will be appreciated that while in a preferred embodiment of the invention collapsible tube 61 is positioned securely inside dispensing device 1 by means of a tube clip 67 which is mounted on mounting base 5 by means of a pair of tube clip arms 68, alternative tube mounting means known to those skilled in the art may be used to secure collapsible tube 61 inside dispensing device 1. Furthermore, referring again to FIG. 2, it will be further appreciated that in the embodiment of this invention wherein the dispensing device includes a base pin 44 carried by engaging plate leg 42 of engaging plate 40 to move in lever stop slot 15, the length of lever stop slot 15 can be varied or adjusted to control the length of travel of lever 20, and the amount of paste or cream ejected from nozzle 26 for each manipulation of lever 20.

Accordingly, having described my invention with the particularlity set forth above, what is claimed is:

1. A dispensing device comprising:

(a) a container having an outlet passage and including an upward standing base, a cover base attached to said base, a horizontally disposed brush holder having one end attached to said cover base, and a cover removably fitted over said base, said cover base, and a portion of said brush holder;

(b) clamp means within said cover and mounted on said base for supporting a collapsible tube with the mouth of said tube cooperating with said outlet passage;

(c) a pull chain having discreet balls connected in spaced relationship by discreet links, and a spring carrying one end of said chain and mounted in the interior of said container;

(d) a slotted lever slidably carried by said brush holder and positioned beneath said outlet passage and carrying the opposite end of said chain from said spring; and (e) tube collapse means including a carriage slidably and vertically carried by the interior wall of said base; a retaining means fitted to said carriage for selectively engaging said balls of said pull chain; and a roller rotatably attached to said carriage and positioned against said collapsible tube to force said collapsible tube against the inside of said cover responsive to engagement of said retaining means with said balls by manipulation of said lever.

2. The dispensing device of claim 1 further comprising chain roller means rotatably mounted in said cover base and carrying said pull chain to orient said pull chain in said brush holder, said cover base and said base.

3. The dispensing device of claim 1 wherein said brush holder further comprises a plurality of apertures for supporting toothbrushes and a seat for supporting a container.

4. A dispensing device comprising:

(a) an upward standing base having a vertically oriented slot therein and a cover base carried by said base;

(b) a generally horizontally disposed brush holder having one end secured to said cover base and projecting from said cover base at essentially a 90 degree angle with respect to said base, and having a lever aperture and a paste aperture therein;

(c) an outlet nozzle carried by said brush holder and having an outlet cooperating with said paste aperture;

(d) a slotted lever slidably disposed in said lever aperture beneath said outlet nozzle and said outlet;

(e) a chain having one end connected to said lever and the other end cooperating with said vertically oriented slot and said base;

(f) a carriage in registration with said vertically oriented slot in said base, and a roller rotatably attached to said carriage;

(g) clamp means carried by said base for supporting a collapsible tube in generally parallel relationship to said base with the opening of said tube cooperating with said paste aperture in said brush holder;

(h) a cover removably fitted over said base, said cover base and said collapsible tube; and (i) a retaining arm pivotally carried by said carriage and selectively cooperating with said chain whereby said carriage is caused to traverse said base, and said roller forces said collapsible tube against said cover to press the contents of said tube through said paste aperture and from said nozzle, in response to manipulation of said lever.

5. The dispensing device of claim 4 further comprising:

(a) chain roller means rotatably mounted in said cover brush and carrying said pull chain to orient said chain in said brush holder, said cover base and said base; and (b) a spring carried by said base near the top of said base and attached to one end of said chain at a point above said carriage.

6. The dispensing device of claim 4 wherein said brush holder further comprises a plurality of apertures for supporting toothbrushes and a recess for supporting a container; said slotted lever comprises a lever handle, a first slot near said lever handle, and a second slot having oppositely disposed shoulders on each side thereof in the opposite end of said lever from said lever handle; and further comprising a base rest carried by said cover base and an engaging plate attached to one end of said chain and slidably disposed in said second slot of said slotted lever whereby said first slot is positioned below said outlet of said outlet nozzle and said shoulders engage said engaging plate when said lever is retracted to a predetermined point, and said engaging plate is displaced, said carriage is forced downwardly, and said roller forces collapse of said collapsible tube when said lever is further retracted.

7. The dispensing device of claim 4 wherein said slotted lever comprises a lever handle, a first slot near said lever handle, and a second slot having oppositely disposed shoulders on each side thereof in the opposite end of said lever; and further comprising:

(a) chain roller means rotatably mounted in said said cover base and carrying said pull chain to orient said pull chain in said brush holder, said cover base and said base;

(b) a spring carried by said base near the top of said base and attached to one end of said chain at a point above said carriage; and (c) a base rest carried by said brush holder and an engaging plate attached to one end of said chain and slidably disposed in said second slot of said slotted lever whereby said first slot is positioned beneath said outlet of said outlet nozzle and said shoulders engage said engaging plate when said lever is retracted to a predetermined point and said engaging plate is displaced, said carriage is forced downwardly with said chain, and said roller forces partial collapse of said collapsible tube when said lever is further retracted.

8. The dispensing device of claim 7 further comprising a lever stop slot provided in said brush holder beneath said engaging plate and a base pin carried by said engaging plate and projecting into said lever stop slot for limiting the travel of said slotted lever.

9. The dispensing device of claim 7 further comprising a surge chamber provided in said paste aperture to reduce pressure in said paste aperture after each manipulation of said slotted lever.

10. The dispensing device of claim 7 further comprising an arm bias carried by said carriage and cooperating with said retaining arm to bias said retaining arm against said chain and facilitate movement of said carriage with said chain in response to to manipulation of said slotted lever.

11. The dispensing device of claim 4 wherein said brush holder further comprises a plurality of apertures for supporting toothbrushes and a recess for supporting a container; said slotted lever comprises a lever handle, a first slot near said lever handle, and a second slot having oppositely disposed shoulders on each side thereof in the opposite end of said lever; and further comprising:

(a) a chain roller rotatably mounted in said, said cover base and carrying said pull chain to orient said pull chain in said brush holder, said cover base and said base;

(b) a spring carried by said base near the top of said base and attached to one end of said chain at a point above said carriage;

(c) a base rest carried by said brush holder and an engaging plate attached to one end of said chain and slidably disposed in said second slot of said slotted lever whereby said first slot is positioned beneath said outlet of said outlet nozzle and said shoulders engage said engaging plate when said lever is retracted to a predetermined point, and said engaging plate is displaced, said carriage is forced downwardly with said chain, and said roller forces partial collapse of said collapsible tube when said lever is further retracted;

(d) a surge chamber provided in said paste aperture to reduce pressure in said paste aperture after each manipulation of said slotted lever; and (e) an arm bias carried by said carriage and cooperating with said retaining arm to bias said retaining arm against said chain and facilitate movement of said carriage with said chain in response to to manipulation of said slotted lever.

* * * * *